US005126069A

United States Patent [19]

Kud et al.

[11] Patent Number: 5,126,069

[45] Date of Patent: Jun. 30, 1992

[54] WATER-SOLUBLE OR -DISPERSIBLE, OXIDIZED POLYMER DETERGENT ADDITIVES

[75] Inventors: Alexander Kud, Eppelsheim; Richard Baur, Mutterstadt; Angelika Funhoff, Heidelberg; Walter Denzinger, Speyer; Heinrich Hartmann, Limburgerhof; Hans-Juergen Raubenheimer, Ketsch, all of Fed. Rep. of Germany

[73] Assignee: BASF Aktiengesellschaft, Ludwigshafen, Fed. Rep. of Germany

[21] Appl. No.: 596,325

[22] Filed: Oct. 12, 1990

[30] Foreign Application Priority Data

Oct. 13, 1989 [DE] Fed. Rep. of Germany ..... 3934184

[51] Int. Cl.[5] ..... C11D 1/00

[52] U.S. Cl. ..... 252/174.23; 252/DIG. 2; 252/95; 252/DIG. 11

[58] Field of Search ..... 252/174.23, DIG. 2, 252/95, DIG. 11

[56] References Cited

U.S. PATENT DOCUMENTS

| | | | |
|---|---|---|---|
| 3,637,609 | 1/1972 | Blumberg et al. | 525/366 |
| 3,691,139 | 9/1972 | Blumbergs et al. | 260/78.4 R |
| 3,755,264 | 8/1973 | Testa | 525/327.8 |
| 3,853,781 | 12/1974 | Haschke et al. | 252/132 |
| 3,887,480 | 6/1975 | Rue et al. | 252/135 |
| 3,922,230 | 11/1975 | Lamberti et al. | 252/174.24 |

FOREIGN PATENT DOCUMENTS

| | | |
|---|---|---|
| 0025551 | 3/1981 | European Pat. Off. . |
| 0075820 | 4/1983 | European Pat. Off. . |
| 0404377 | 4/1990 | European Pat. Off. . |
| 2388834 | 11/1978 | France . |

*Primary Examiner*—Paul Lieberman
*Assistant Examiner*—M. DiNunzio
*Attorney, Agent, or Firm*—Oblon, Spivak, McClelland, Maier & Neustadt

[57] ABSTRACT

A detergent composition contains as essential ingredients surfactants and from 0.1 to 15% by weight of water-soluble or -dispersible polymers obtainable by oxidation of polymers containing not less than 10 mol % of carboxyl-containing monoethylenically unsaturated monomers as copolymerized units and having Fikentscher K values of from 8 to 300.

5 Claims, No Drawings

WATER-SOLUBLE OR -DISPERSIBLE, OXIDIZED POLYMER DETERGENT ADDITIVES

Detergents, as will be known, contain not only surfactants but also builders. Builders have many functions in detergent formulations. For instance, they are intended to augment the soil detaching action of the surfactants; render the hardness of the water harmless, whether by sequestration of the alkaline earth metal ions or by dispersing the hardness products precipitated from the water; promote the dispersion and stabilization of the colloidal soil particles in the wash liquor; and act as buffers to maintain the most suitable pH during the wash. In solid detergent formulations, builders are also intended to make a positive contribution to a satisfactory powder structure and free-flow properties. Phosphate-based builders are very efficient at the above-described tasks. Consequently, pentasodium triphosphate was for a long time the unchallenged builder of choice in detergent compositions. However, the phosphates present in detergents pass virtually unchanged into the effluent. Since phosphates are an excellent nutrient for aquatic plants and algae, they are responsible for the eutrophication of lakes and slow water courses.

Water treatment installations without a third treatment stage for the specific precipitation of phosphates are not sufficiently effective in removing phosphates. For this reason there has long been a search under way for something to take the place of phosphate builders in detergents.

In the meantime, water-insoluble ion exchange materials based on zeolites have found their way in phosphate-free or low-phosphate detergents. However, owing to their specific properties zeolites are incapable of replacing phosphate builders alone. They are augmented in their activity by other detergent additives comprising carboxyl-containing compounds, such as citric acid, tartaric acid, nitrilotriacetic acid and in particular polymeric carboxyl-containing compounds and salts thereof. Of the last group of compounds mentioned, the homopolymers of acrylic acid and the copolymers of acrylic acid and maleic acid have particular importance as detergent additives; cf. U.S. Pat. No. 3,922,230 and EP Patent 25,551. The incrustation inhibitors used are in particular homopolymers of acrylic acid and copolymers of maleic acid and acrylic acid having molecular weights of about 50,000–120,000. However, these polymers are not capable of augmenting the removal of particulate soil (e.g. clay, kaolin, soot) or the dispersal thereof in washing liquors. Suitable for this purpose are in particular low molecular weight polyacrylic acids which in turn, however, are poor incrustation inhibitors.

It is an object of the present invention to provide a polymer suitable for use in detergent compositions which is not only an effective incrustation inhibitor but also an effective dispersant of particulate soil.

We have found that this object is achieved according to the present invention by using a water-soluble or -dispersible polymer obtainable by oxidation of a polymer which contains not less than 10 mol % of carboxyl-containing ethylenically unsaturated monomers as copolymerized units and has K values of from 8 to 300 (determined by the method of H. Fikentscher in aqueous solution at 25° C. and pH 7 on the sodium salt of the polymer at a concentration of 1% by weight) as an additive in detergent compositions in an amount of from 0.1 to 15% by weight, based on the particular formulation.

To obtain the detergent additives to be used according to the present invention, carboxyl-containing polymers which contain not less than 10 mol % of carboxyl-containing ethylenically unsaturated monomers as copolymerized units and which are water-soluble or -dispersible at least in the form of the salts are oxidized. To prepare the carboxyl-containing polymers, the monomers of group (a) are subjected to polymerization either alone or mixed. Suitable group (a) monomers are for example monoethylenically unsaturated monocarboxylic acids having from 3 to 8 carbon atoms and monoethylenically unsaturated dicarboxylic acids having from 4 to 8 carbon atoms in the molecule. Examples of these compounds are acrylic acid, methacrylic acid, vinylacetic acid, allylacetic acid, propylideneacetic acid, ethylenepropionic acid, ethylidenepropionic acid, dimethylacrylic acid, ethylacrylic acid, crotonic acid, maleic acid, fumaric acid, itaconic acid, methaconic acid, methylenemalonic acid, citraconic acid, and also salts or, if existent, anhydrides thereof. These monomers are polymerized either to homopolymers or to copolymers.

The monomers of group (a) may also be copolymerized with the monomers of group (b). The monomers of group (b) are carboxyl-free ethylenically unsaturated compounds. The resulting copolymers are water-soluble or -dispersible at least in the form of the alkali metal or ammonium salts. Preferred monomers of group (b) are the esters, amides and nitriles of the carboxylic acids mentioned under (a). Preferred compounds of these classes are for example methyl acrylate, ethyl acrylate, methyl methacrylate, ethyl methacrylate, hydroxyethyl acrylate, hydroxypropyl acrylates, hydroxybutyl acrylates, hydroxyethyl methacrylate, hydroxypropyl methacrylates, hydroxybutyl methacrylates, dimethylaminoethyl acrylate, dimethylaminoethyl methacrylate, diethylaminoethyl acrylate, diethylaminoethyl methacrylate, acrylamide, methacrylamide and also N-alkylacrylamides and N-alkylmethacrylamides having from 1 to 18 carbon atoms in the alkyl moiety. Examples thereof are N-dimethylacrylamide, tert.-butylacrylamide, the monoamides and diamides of maleic acid, dimethylaminopropyl methacrylamide, acrylamidoglycolic acid, acrylonitrile and methacrylonitrile. The copolymers with basic monomers are preferably used in the form of the salts with mineral acids, such as hydrochloric acid or sulfuric acid, or in quaternized form. Suitable quaternizing agents are for example dimethyl sulfate, diethyl sulfate, methyl chloride, ethyl chloride and benzyl chloride. The monomers of group (b) serve to modify the polymers of the monomers of group (a). The monomers of group (b) never account for more than 90 mol % of a copolymer. It is of course possible to use mixtures of monomers of group (b) together with monomers of group (a) in the copolymerization and copolymerize for example a mixture of acrylic acid, methyl acrylate and hydroxypropyl acrylate.

A further modification of the carboxyl-containing polymers may be effected by carrying out the polymerization of the monomers of group (a) with or without monomers of group (b) in the presence of monomers of group (c). This group includes for example sulfo-containing monomers, such as vinylsulfonic acid, allylsulfonic acid, methallylsulfonic acid, styrenesulfonic acid, 3-sulfopropyl acrylate, 3-sulfopropyl methacrylate and acrylamidomethylpropanesulfonic acid, and phosphono-containing monomers, for example vinyl phosphonate, allyl phosphonate and acrylamidomethylpropanephosphonic acid. It is also possible to use as monomers of group (c) N-vinylpyrrolidone, N-vinylcaprolactam, N-vinylformamide, N-vinyl-N-methylformamide, N-vinylacetamide, N-vinyl-N-methylacetamide, N-vinylimidazole, N-vinylmethylimidazole, N-vinyl-2-methylimidazoline, vinyl acetate, vinyl propionate, vinyl butyrate, styrene, olefins of from 2 to 10 carbon atoms, such as ethylene, propylene, isobutylene, hexene and diisobutene, and vinyl alkyl ethers, such as methyl vinyl ether, ethyl vinyl ether, n-butyl vinyl ether, isobutyl vinyl ether, hexyl vinyl ether and octyl vinyl ether, and mixtures thereof. The copolymers of the ethylenically unsaturated monomers which contain carboxylic acid, sulfonic acid and phosphonic acid groups may be subjected to the oxidation in the form of the free acids or in a partially or completely neutralized form. Neutralization is preferably effected using alkali metal bases, such as sodium hydroxide solution and potassium hydroxide solution, ammonia or amines, such as trimethylamine, ethanolamine or triethanolamine. The monomers of group (c) may be copolymerized with the monomers of group (a) and optionally the monomers of group (b) either alone or mixed with one another. The modified monomers of group (c), if used at all, never account for more than 90 mol %, preferably 10–50 mol %, of the copolymer.

The copolymers may additionally contain as copolymerized units a further class of monomers of group (d), which are monomers having two or more ethylenically unsaturated double bonds, these double bonds being nonconjugated. Suitable compounds of group (d) are for example methylenebisacrylamide, N,N-divinylethyleneurea, N,N-divinylpropyleneurea, ethylidene bis-3-vinylpyrrolidone and esters of polyhydric alcohols such as glycol, butanediol, glycerol, pentaerythritol, glucose, fructose, sucrose, polyalkylene glycols of a molecular weight of 400 to 6000 and polyglycerols of molecular weight 126–268 with acrylic acid, methacrylic acid, maleic acid and fumaric acid using per mole of alcohol used at least 2 mol of one of the carboxylic acids mentioned or else a mixture of the carboxylic acids mentioned. Further suitable monomers of group (d) are for example divinylbenzene, divinyldioxane, divinyl adipate, divinyl phthalate, pentaerythritol triallyl ether, pentaallylsucrose, diallyl ethers and divinyl ethers of polyalkylene glycols of molecular weight 400–6000, ethylene glycol divinyl ether, butanediol divinyl ether and hexanediol divinyl ether. The modifier monomers of group (d), if used at all, never account for more than 5 mol % of the copolymer.

Particular preference for use in detergent formulations is given to reaction products which are obtainable by oxidizing homopolymers and copolymers of acrylic acid, methacrylic acid, maleic acid, fumaric acid and itaconic acid. The carboxyl-containing polymers subjected to oxidation have K values of from 8 to 300, preferably from 10 to 150. These K values are determined by the method of H Fikentscher in aqueous solution at 25° C. and pH 7, in each case on the sodium salt of the polymer at a concentration of 1% by weight.

Suitable oxidizing agents are those which release oxygen on being heated alone or in the presence of catalysts. Suitable organic compounds are in general peroxides, which eliminate active oxygen very readily. At low temperatures only hydroperoxides and peracids have a significant oxidizing effect; peresters, diacyl peroxides and dialkyl peroxides become active only at higher temperatures.

Suitable peroxides are for example diacetyl peroxide, isopropyl percarbonate, tert.-butyl hydroperoxide, cumene hydroperoxide, acetylacetone peroxide, methyl ethyl ketone peroxide, di-tert.-butyl peroxide, dicumyl peroxide, tert.-butyl perpivalate, tert.-butyl peroctanoate and tert.-butyl perethylhexanoate. Preference is given to the inexpensive inorganic oxidizing agents which are suitable in particular for oxidizing aqueous solutions of the carboxyl-containing polymers. Examples which may be mentioned are chlorine, bromine, iodine, nitric acid, sodium permanganate, potassium chlorate, sodium hypochlorite, sodium perborate, sodium percarbonate and sodium persulfate. A particularly preferred oxidizing agent is hydrogen peroxide. The decomposition of the percompounds, i.e. the oxidation, can be speeded up by the addition of accelerants or activators. Such mixtures of percompounds and accelerants are customarily used in the polymerization of monomers as redox catalysts. The accelerants or activators are reducing but slightly electron-releasing substances such as, for example, tert.-amines, sulfinic acids, dithionites, sulfites, $\alpha$- and $\beta$-ketocarboxylic acids, glucose derivatives and heavy metals, preferably in the form of soluble salts of inorganic or organic acids or complexes. Specific examples are dimethylaniline, dimethyl-p-toluidine, diethylaniline, sodium dithionite, sodium sulfite, ascorbic acid, glucose, pentaacetylglucose, ferroammonium sulfate, copper chloride and the acetylacetonates of iron, copper, cobalt, chromium, manganese, nickel and vanadium.

The oxidizing agents are added, based on the polymers, in amounts of from 2 to 50% by weight, preferably from 5 to 30% by weight. The reducing agents are used, calculated on the oxidizing agents, in amounts of from 2 to 50% by weight. The heavy metal compounds are used, calculated as heavy metal and based on the polymer, in amounts of from 0.1 to 100 ppm, preferably from 0.5 to 10 ppm. It is frequently of advantage to add to the percompounds not only reducing agents but also heavy metal compounds to speed up the reaction in particular if it is carried out at low temperatures. The reaction temperatures can vary from 20° C. to 150° C., preferably from 50° C. to 120° C. It is also advantageous on occasion to speed up the oxidation by irradiation with UV light, or else to oxidize at low temperatures and for a short time, in particular if only the —S— groups in the polymer are to be oxidized without a decrease in the K value. It is also possible to use air and oxygen alone or combined with oxidizing agents.

Those polymers with a high K value are strongly degraded in the course of the oxidation, while low molecular weight polymers are degraded only to a relatively small degree. The degree of degradation of the polymers in the course of the oxidation is easy to determine by comparing the K values of unoxidized polymer with the K value of the oxidized polymer. For example, a sodium polyacrylate of K value 90 is oxidized by 10% of hydrogen peroxide and 8 hours, heating at 98° C. to a K value of 28. By contrast, a sodium polyacrylate of K value 28 subjected to the same reaction conditions will at the end of the oxidation have a K value of 23.

To oxidize the carboxyl-containing polymers, the oxidizing agents are made to act either on the pulverulent polymers directly or on suspensions of the polymers in an inert medium or on solutions in inert solvents. Suitable solvents for the polymers are for example methanol, ethanol, n-propanol, isopropanol, water and solvent mixtures which contain water. Preferably, the oxidation is carried out in aqueous polymer solutions or dispersions. The oxidation of carboxyl-containing polymers results not only in a reduction of the molecular weights of the polymers but also in the oxidation of functional groups, for example S groups, which are formed in the course of the polymerization of monomers (a) with or without monomers (b) to (d) in the presence of mercapto compounds as regulators. Suitable mercapto compounds are for example mercaptoethanol, mercaptopropanols, mercaptobutanols, mercaptoacetic acid, mercaptopropionic acid, mercaptobutyric acid, n-butylmercaptan, tert.-butylmercaptan and dodecylmercaptan.

The carboxyl-containing polymers obtainable by oxidation are excellent additives for detergents. They are remarkable in that, compared with the unoxidized carboxyl-containing polymers, they show an unexpectedly improved calcium carbonate dispersing capacity and exhibit a high stability in detergents containing oxidizing agents. In chlorine-containing detergents, for example, they are more stable than the unoxidized polymers. The carboxyl-containing polymers obtainable by oxidation are used in amounts of from 0.1 to 15, preferably from 0.5 to 10, % by weight as additives in detergents, based on the detergent formulation. These formulations may be pulverulent or else liquid. Detergent formulations are customarily based on surfactants with or without builders. In pure liquid detergents, the use of builders is usually dispensed with. Suitable surfactants are for example anionic surfactants, such as $C_8$–$C_{12}$-alkylbenzenesulfonates, $C_{12}$–$C_{16}$-alkanesulfonates, $C_{12}$–$C_{16}$-alkyl sulfates, $C_{12}$–$C_{16}$-alkyl sulfosuccinates and sulfated ethoxylated $C_{12}$–$C_{16}$-alkanols, and also nonionic surfactants, such as $C_8$–$C_{12}$-alkylphenol ethoxylates, $C_{12}$–$C_{20}$-alkanol alkoxylates and also block copolymers of ethylene oxide and propylene oxide. The end groups of the polyalkylene oxides may be capped, meaning that the free OH groups of the polyalkylene oxides may be etherified, esterified, acetalized and/or aminated. A further possible modification is to react the free OH groups of the polyalkylene oxides with isocyanates.

The nonionic surfactants also include $C_4$–$C_{18}$-alkylglucosides and the alkoxylated products obtainable therefrom, in particular those preparable by reaction of alkylglucosides with ethylene oxide. The surfactants usable in detergents may also have a zwitterionic character and be soaps. The surfactants are in general present in detergent compositions in an amount of from 2 to 50, preferably from 5 to 45% by weight.

Detergent builders are for example phosphates, e.g. orthophosphate, pyrophosphate and especially pentasodium triphosphate, zeolites, sodium carbonate, polycarboxylic acids, nitrilotriacetic acid, citric acid, tartaric acid, the salts of said acids and also monomeric, oligomeric or polymeric phosphonates. The individual substances are used in the detergent formulations in varying amounts, for example sodium carbonate in amounts of up to 80%, phosphates in amounts of up to 45%, zeolites in amounts of up to 40%, nitrilotriacetic acid and phosphonates in amounts of up to 10% and polycarboxylic acids in amounts of up to 20%, each percentage being based on the weight of the substances and on the detergent formulation as a whole. Owing to the environmental damage caused by the use of phosphates, the level of phosphates in detergent compositions is increasingly reduced, so that present-day detergents contain not more than 25% of phosphate or are phosphate-free.

The oxidized polymers can also be used in liquid detergents. Liquid detergent blends customarily contain liquid surfactants or alternatively solid surfactants which are soluble or at least dispersible in the detergent blend. Suitable surfactants for this purpose are products which are also used in pulverulent detergents and also liquid polyalkylene oxides or polyalkoxylated compounds.

Detergent formulations may also contain corrosion inhibitors, such as silicates. Suitable silicates are for example sodium silicate, sodium disilicate and sodium metasilicate. Corrosion inhibitors can be present in the detergent formulation in amounts of up to 25% by weight. Further customary additives for detergent formulations are bleaching agents, which may be present therein in an amount of up to 30% by weight. Suitable bleaching agents are for example perborates and chlorine-releasing compounds, such as chloroisocyanurates. Another group of additives which may be present in detergents are grayness inhibitors. Known substances of this kind are carboxymethylcellulose, methylcellulose, hydroxypropylmethylcellulose and graft polymers of vinyl acetate on polyalkylene oxides of molecular weight 1000–15,000. Grayness inhibitors may be present in the detergent formulation in amounts of up to 5%. Further customary but optional additives for detergents are fluorescent whitening agents, enzymes and scents. Pulverulent detergents may also contain up to 50% by weight of a strength standardizing diluent, such as sodium sulfate. Detergent formulations may be free of water or contain small amounts, for example up to 10% by weight, of water. Liquid detergents customarily contain up to 80% by weight of water. Customary detergent formulations are described in detail for example in DE-A-3,514,364, which is hereby expressly incorporated herein by reference.

The K values of the polymers were determined by the method of H. Fikentscher, Cellulose Chemie 13 (1932), 58–64, 71–74. Note that $K=k\times10^3$. The measurements were carried out on 1% strength aqueous solutions of the sodium salts of the polymers at 25° C. and pH 7. Unless otherwise stated, the % ages are by weight.

EXAMPLES

Preparation of oxidized polymers

Polymer 1

500 g of a 35% strength aqueous solution of a copolymer of K 91 formed from maleic acid and vinyl methyl ether in a molar ratio of 1:1 and 95% neutralized with sodium hydroxide were heated to about 95° C. 117 g of a 30% strength aqueous solution of hydrogen peroxide were metered in at a uniform rate over 8 hours. This is followed by a further 2 hours of heating and then cooling. Following the oxidation the K value of the polymer was 22.

Polymer 2

1500 g of 36% strength aqueous solution of a polyacrylic aid of K 99 were heated to a slow boil at 100° C. 175 g of a 30% strength aqueous hydrogen peroxide solution were metered in at a uniform rate over 8 hours. Thereafter the reaction mixture was cooled. It had a solids content of 32%. The K value of the oxidized polyacrylic acid was 67.

Polymer 3

750 g of a sodium polyacrylate of K 28 prepared using 4.5% of 2-mercaptoethanol (calculated on acrylic acid used) were heated to 95° C. in the form of a 45% strength solution in water, and 226 g of a 30% strength aqueous hydrogen peroxide solution were added in the course of 8 hours. Subsequently the reaction mixture was heated for a further 4 hours and then cooled down. The solids content of the polymer solution was 42%. The oxidized polymer had a K value of 26.

Polymer 4

1.2 kg of a 40% strength aqueous solution of a copolymer of K 64 formed from 70% of acrylic acid and 30% of maleic acid and 90% neutralized with sodium hydroxide were heated in a stirred autoclave to 110° C. under super-atmospheric pressure. 358 g of a 30% strength aqueous hydrogen peroxide solution were metered in continuously over 8 hours. The polymer solution obtained was then cooled down. The solids content of the aqueous solution was 30%. The oxidized polymer had a K value of 19.

Polymer 5

1.5 kg of a 40% strength aqueous solution of a copolymer of K 64 formed from 70% of acrylic acid and 30% of maleic acid and 90% neutralized with sodium hydroxide were admixed with a suspension of 60 g of sodium perborate in 240 g of water, and the mixture was heated at 100° C. under superatmospheric pressure for 4 hours. The solution was then cooled down. It had a solids content of 36%. The K value of the oxidized polymer was 49.

Polymer 6

500 g of a poly(sodium acrylate) of K 21 prepared using 8% of 2-mercaptoacetic acid (calculated on acrylic acid used) were admixed in the form of a 46% strength aqueous solution with 1 ml of a 0.1% strength aqueous copper(II) chloride solution, and the mixture was heated to 50° C. A solution of 37.6 g of 30% strength hydrogen peroxide and 50 g of water were added over 4 hours, and subsequently the reaction mixture was heated for a further hour before being cooled down. The aqueous solution had a solids content of 45%. The oxidized homopolymer had a K value of 20.

Polymer 7

1200 g of a 40% strength aqueous solution of the sodium salt of a copolymer of K 60 formed from 70% of acrylic acid and 30% of maleic acid were admixed with 4.8 g of a 0.1% strength copper(II) chloride solution, and the mixture was heated to 80° C. As soon as that temperature was reached, 288 g of 50% strength hydrogen peroxide and a solution of 9.6 g of sodium disulfite and 70.4 g of water were added at a uniform rate over 8 hours, and subsequently the reaction mixture was heated at 80° C. for a further hour. This gave a solution of an oxidized polymer having a solids content of 30%. The K value of the oxidized polymer was 15.

Polymer 8

1000 g of a 40% strength aqueous solution of the sodium salt of a copolymer of K 60 formed from 70% of acrylic acid and 30% of maleic acid were admixed with 14 g of a 0.1% strength iron(II) ammonium sulfate solution, and the mixture was heated to the boil. 134 g of a 30% strength hydrogen peroxide solution were added to the boiling mixture over 8 hours, and the mixture was subsequently heated at the boil for a further hour before being cooled down. The solids content of the polymer solution was 36%. The oxidized polymer had a K value of 27.

Polymer 9

1000 g of a 40% strength aqueous solution of the sodium salt of a copolymer of K 60 formed from 70% of acrylic acid and 30% of maleic acid were heated to the boil and admixed in the course of 8 hours, at a uniform rate, with 134 g of a 30% strength aqueous hydrogen peroxide solution and a solution of 8 g of ascorbic acid in 50 g of water. Thereafter the reaction mixture was heated at the boil for a further hour. This gave a solution of an oxidized copolymer having a solids content of 36%. The K value of the oxidized copolymer was 28.

Polymer 10

30 g of a polyacrylate of K 29 prepared using 4.5% by weight of 3-mercaptopropionic acid (calculated on acrylic acid used) were admixed in the form of a 53% strength aqueous solution with 0.02 ml of a 0.01% strength aqueous solution of iron(II) ammonium sulfate and 2.65 g of 30% strength hydrogen peroxide. This solution was heated to 90° C. and left at that temperature for 10 hours. On cooling, the solution was found to have a solids content of 43.7%. The oxidized homopolymer had a K value of 29.

Polymer 11

1000 g of a 40% strength aqueous solution of the sodium salt of a copolymer of K 50 formed from 50% of acrylic acid and 50% of maleic acid were heated to the boil under atmospheric pressure and admixed over 8 hours at a uniform rate with 240 g of 50% strength hydrogen peroxide. After all the hydrogen peroxide had been added, the reaction mixture was heated at the boil for a further hour. The aqueous solution had a solids content of 32%. The oxidized copolymer had a K value of 14.

Polymer 12

1500 g of a 34% strength aqueous solution of a commercial sodium polyacrylate of K 80 were heated to 98° C. under atmospheric pressure and admixed at the stated temperature with 308 g of a 50% strength aqueous hydrogen peroxide solution in the course of 24 hours. The reaction mixture was then cooled down. It had a solids content of 28%. The K value of the oxidized homopolymer was 16.

Polymer 13 (Comparison)

Sodium polyacrylate of K 15 obtainable by solution polymerization of acrylic acid in water using 12% of 2-mercaptoethanol.

Polymer 14 (Comparison)

Sodium polyacrylate of K 40 obtainable by solution polymerization of acrylic acid in water using 3 % of 2-mercaptoethanol.

Polymer 15 (Comparison)

Sodium polyacrylate of K 20 obtainable by solution polymerization of acrylic acid in water using 8% of 2-mercaptoacetic acid.

Polymer 16 (Comparison)

Sodium salt of a commercial copolymer of K 60 formed from 70% of acrylic acid and 30% of maleic acid.

Polymer 17 (Comparison)

Sodium salt of a commercial copolymer of K 50 formed from 50% of acrylic acid and 50% of maleic acid.

APPLICATION EXAMPLES

To test the incrustation inhibiting effect of the above-described oxidized polymers, each polymer was incorporated into two different pulverulent detergents A and B. Each of these washing powder formulations was used to wash test fabrics made of cotton terry towelling. The number of wash cycles was 15. Following this number of washes, each fabric was ashed to determine its ash content. The lower the ash content of the test fabric, the greater the effectiveness of the polymer ingredient of the washing powder, reported as a percentage where 0% effectiveness denotes the highest possible ash content or incrustation buildup without additive in the washing powder and 100% effectiveness denotes complete prevention of any deposit by the incrustation inhibitor. Following the 15 wash cycles, the terry towelling had an ash content of 2.5% in the case of washing powder A and 2.38% in the case of washing powder B.

| Experimental conditions for determining incrustation: | |
|---|---|
| Apparatus: | Launder-O-Meter from Atlas, Chicago |
| Number of wash cycles: | 15 |
| Wash liquor: | 250 g, the water used containing 4 mmol of hardness per liter (molar ratio of calcium to magnesium equal to 3:1) |
| Length of wash: | 30 min at 60° C. (including heating-up time) |
| Detergent dosage: | 8 g/l |
| Terry towelling cloth: | 20 g |
| Washing powder A (phosphate-free) | |
| 12.5% | of dodecylbenzenesulfonate (50%) |
| 4.7% | of $C_{13}/C_{15}$-oxo process alcohol polyglycol ether containing 7 ethylene oxide units |
| 2.8% | of soap |
| 25% | of zeolite A |
| 12% | of sodium carbonate |
| 4% | of sodium disilicate |
| 1% | of magnesium silicate |
| 20% | of sodium perborate |
| 10% | of copolymer |
| 0.6% | of sodium carboxymethylcellulose |
| remainder to 100%: sodium sulfate | |
| Washing powder B (reduced phosphate) | |
| 12.5% | of dodecylbenzenesulfonate (50%) |
| 4.7% | of $C_{13}/C_{15}$ oxo process alcohol polyglycol ether containing 7 ethylene oxide units |
| 2.8% | of soap |
| 9.25% | of pentasodium triphosphate |
| 0.7% | of sodium diphosphate |
| 0.05% | of sodium orthophosphate |
| 24% | of zeolite A |
| 4% | of sodium disilicate |
| 1% | of Mg silicate |
| 20% | of sodium perborate |
| 3% | of polymer |
| remainder to 100%: sodium sulfate | |

Table 1 shows the effectiveness of the oxidized polymers of varying K. Table 2 shows the effectiveness of the unoxidized polymers.

TABLE 1

| Example No. | Polymer No. | K value | Effectiveness (%) on terry towelling Powder A | Effectiveness (%) on terry towelling Powder B |
|---|---|---|---|---|
| 1 | 12 | 16.1 | 83.2 | 47.4 |
| 2 | 6 | 19 | 86.5 | 69.1 |
| 3 | 8 | 27 | 82.4 | 81.3 |
| 4 | 3 | 25.5 | — | 78.3 |

TABLE 2

| Comparative Example No. | Polymer No. | K value | Effectiveness (%) on terry towelling Powder A | Effectiveness (%) on terry towelling Powder B |
|---|---|---|---|---|
| 1 | 13 | 15.0 | 73.4 | 29.1 |
| 2 | 14 | 38.0 | 84.1 | 76.9 |
| 3 | 15 | 20.0 | 81.6 | 52.2 |
| 4 | 16 | 60.0 | 86.4 | 84.3 |

Tables 1 and 2 reveal that the oxidized homopolymers of acrylic acid are more effective incrustation inhibitors than the unoxidized homopolymers of similar K and hence similar molecular weight. It is also evident that the oxidized copolymer of acrylic acid is not less effective than the unoxidized copolymer although the K value of the oxidized copolymer is distinctly lower than that of the unoxidized copolymer.

Clay dispersion

The removal of particulate soil from fabric surfaces is augmented by the addition of polyelectrolytes. The stabilization of the dispersion formed by the detached particles is an important function of these polyelectrolytes. The stabilizing effect of anionic dispersants is due to the fact that the adsorption of dispersant molecules on the surfaces of the solids increases their surface charge and the repellence. Further variables determining the stability of the dispersion include, inter alia, steric effects, temperature, the pH and the electrolyte concentration.

The following clay dispersion (CD) test provides a simple way of assessing the dispersing power of various polyelectrolytes:

CD test

The particulate soil model used is a finely ground china clay SPS 151. 1 g of clay is thoroughly dispersed in 98 ml of water in a 100 ml measuring cylinder in the presence of 1 ml of a 0.1% strength sodium salt solution of the polyelectrolyte for 10 minutes. Immediately after the stirring has ended a sample of 2.5 ml is taken from the center of the measuring cylinder, diluted with water to 25 ml and placed in a turbidimeter to determine the turbidity. Further samples of the dispersion are taken after 30 and 60 minutes and measured. The turbidity of the dispersion is reported in NTUs (nephelometric turbidity units). The lower the rate of sedimentation of the dispersion during storage, the higher the measured turbidities and the stabler the dispersion.

The second physical variable determined is the dispersion constant $\tau$, which describes the time course of the sedimentation process. Since the sedimentation process can be described to an approximation by a mono-exponential time law, $\tau$ indicates the time at which the turbidity has dropped to the 1/e-th part of the original state at time $t=0$. The higher the $\tau$, the slower the rate of sedimentation of the dispersion.

Determination of the calcium carbonate dispersing capacity (CCDC)

The calcium carbonate dispersing capacity (CCDC) is determined by dissolving 1 g of the polymer in 100 ml of distilled water, neutralizing if necessary by adding 1 g of sodium hydroxide solution, and adding 10 ml of 10% strength sodium carbonate solution. The solution is then titrated with 0.25M calcium acetate solution while the pH and the temperature are kept constant. The pH is set by adding either dilute sodium hydroxide solution or dilute hydrochloric acid solution. The dispersing capacity is determined at 20° C. and pH 11 and at 80° C. and pH 10. The results are reported in Table 3.

TABLE 3

| Clay dispersion test | | | | | | | |
|---|---|---|---|---|---|---|---|
| Example No. | Polymer No. | Turbidity at once | After 30 min | storage 60 min | Dispersion constant | CCDC at 20° C. | CCDC at 80° C. |
| 5 | 4 | 680 | 590 | 570 | 211.3 | 210 | 480 |
| 6 | 5 | 640 | 520 | 450 | 144.5 | 325 | 295 |
| 7 | 8 | 670 | 580 | 520 | 208.0 | 265 | 210 |
| 8 | 9 | 690 | 550 | 540 | 132.3 | 260 | 175 |
| 9 | 13 | 720 | 620 | 600 | 200.6 | 245 | 230 |
| 10 | 3 | 680 | 600 | 550 | 239.7 | 125 | 140 |
| Comparative Example | Polymer No. | Turbidity at once | After 30 min | storage 60 min | Dispersion constant | 20° C. | 80° C. |
| 5 | 16 | 640 | 470 | 380 | 97.2 | 250 | 275 |
| 6 | 17 | 670 | 530 | 460 | 128.0 | 360 | 355 |
| 7 | 15 | 700 | 590 | 530 | 175.5 | 95 | 40 |

The turbidity is given in nephelometric turbidity units and the calcium carbonate dispersing capacity (CCDC) in mg of calcium carbonate per g of polymer sodium salt.

The oxidatively degraded homopolymers and copolymers of acrylic acid of Examples 5 to 10 are much better clay dispersants than the unoxidized starting compounds (Comparative Examples 5 to 7).

This is found on comparing the measured turbidities (the higher the measured value, the better the dispersion) and on considering the dispersion constants. They are distinctly higher than those of the comparative compounds, which indicates a distinct increase in the stability of the dispersion. In addition, the CCDC values are partly improved or at least, despite the oxidative degradation, of the same order of magnitude as those of the untreated homopolymers or copolymers. If Example 8 is compared with the unoxidized starting material (Comparative Example 6), it is seen that, again, oxidation has brought about a distinct improvement in clay dispersion with a slight decrease in the CCDC, although the CCDC still falls well within the range of highly effective incrustation inhibitors.

Determination of the stability of hypochlorite-containing formulations

Hypochlorite-containing formulations are destabilized by low molecular weight polyacrylic acids, and release chlorine. To determine the destabilizing effect, 4 g of polysodium acrylate are dissolved in 100 ml of a formulation containing 1% of active chlorine and the solution is stored at 55° C. for 7 days. Thereafter the residual level of active chlorine is determined iodometrically.

TABLE 4

| Example No. | Polymer No. | Active chlorine content in % immediate after storage | (relative, based on the immediate value) |
|---|---|---|---|
| 11 | 10 | 99 | 60.4 |
| Comparative Example | Polymer No. | Active chlorine content in % immediate after storage | (relative, based on the immediate value) |
| 8 | 13 | 65 | 22.4 |
| 9 | 14 | 91 | 44.3 |
| 10 | 15 | 73 | 31.4 |

On comparing Example 11 with the unoxidized polymers of Comparative Examples 8–10, it is found that oxidation brings about a distinct improvement in the stability of the active chlorine in hypochlorite-containing formulations.

The oxidized homopolymers and copolymers of acrylic acid are not only efficient incrustation inhibitors but also excellent dispersants for particulate soil.

We claim:

1. A detergent composition containing as essential constituents
   (1) one or more anionic surfactants, one or more nonionic surfactants or a mixture thereof and
   (2) from 0.1 to 15% by weight based on the weight of the formulation of a water-soluble or -dispersible polymer prepared by oxidation of the preformed polymer, said preformed polymer containing not less than 10 mol % of carboxyl-containing monoethylenically unsaturated monomers as copolymerized units prior to oxidation and having K values of from 8 to 300 (determined by the method of H. Fikentscher in aqueous solution at 25° C. and pH 7 on the sodium salt of the polymer at a concentration of 1% by weight).

2. A detergent composition as claimed in claim 1, wherein constituent (2) is a homopolymer or copolymer of acrylic acid, methacrylic acid, maleic acid or itaconic acid of K 10–150 which has been oxidized in an aqueous medium.

3. A detergent composition as claimed in claim 1 or 2, wherein the polymer used as constituent (2) is obtained by oxidation with 2–50% by weight of peroxide, hydroperoxide, peracid, perester, hydrogen peroxide, halogen, nitric acid, hypochlorite, perborate, percarbonate, persulfate or a mixture thereof.

4. A detergent composition as claimed in claim 1, wherein the polymer used as constituent (2) is obtained by oxidizing with a mixture of a percompound and a redox catalyst.

5. The detergent composition of claim 1, wherein the polymer used as constituent (2) is obtained by oxidation with an oxidizing agent which releases oxygen on being heated alone or in the presence of catalysts.

* * * * *